US006227267B1

(12) United States Patent
Michell et al.

(10) Patent No.: US 6,227,267 B1
(45) Date of Patent: May 8, 2001

(54) CANTER

(76) Inventors: Steven W. Michell; Brian T. Stroud, both of P.O. Box 8, 3550 - 45th Street, S.E., Salmon Arm, British Columbia (CA), V1E 4N2

( * ) Notice: Subject to any disclaimer, the term of this patent is extended or adjusted under 35 U.S.C. 154(b) by 0 days.

(21) Appl. No.: 09/270,200

(22) Filed: Mar. 15, 1999

(51) Int. Cl.[7] ..... B27C 5/00

(52) U.S. Cl. ..... 144/220; 144/176; 144/223; 144/228; 407/46; 407/101

(58) Field of Search ..... 144/39, 41, 176, 144/218, 220, 223, 228, 241, 373; 407/37, 40, 41, 45, 46, 87, 95, 101, 104

(56) References Cited

U.S. PATENT DOCUMENTS

| | | | |
|---|---|---|---|
| 3,570,567 | 3/1971 | Hickman | 144/220 |
| 3,777,793 | 12/1973 | Miller | 144/220 |
| 4,266,584 | 5/1981 | Lomnicki | 144/39 |
| 4,690,186 | 9/1987 | Chapman | 144/176 |
| 5,505,239 | 4/1996 | Sparks | 144/220 |
| 5,511,597 | 4/1996 | Shantie et al. | 144/220 |
| 5,613,538 | 3/1997 | Brisson | 144/228 |
| 5,709,255 | 1/1998 | Toogood | 144/220 |

*Primary Examiner*—W. Donald Bray
(74) *Attorney, Agent, or Firm*—Antony C. Edwards

(57) ABSTRACT

A wing knife holder for a chipping head includes a plinth for releasable mounting of the knife holder to the chipping head hub, a cantilevered member mounted on the plinth, the cantilevered wing inclined rearwardly and radially outwardly, from an inner end of the member support on the plinth to a cantilevered outer end of the member opposite the inner end. The leading edge of the member is forwardly swept in the direction of rotation of the chipping head from the inner end to the outer end so as to advance the outer end ahead of the inner end. A chip flow passage is formed in the plinth, radially inwardly of the leading edge between the hub and the leading edge. The chip flow passage slopes from an inner opening adjacent the peripheral edge of the hub rearwardly and radially inwardly toward the axis of rotation of the chipping head.

25 Claims, 10 Drawing Sheets

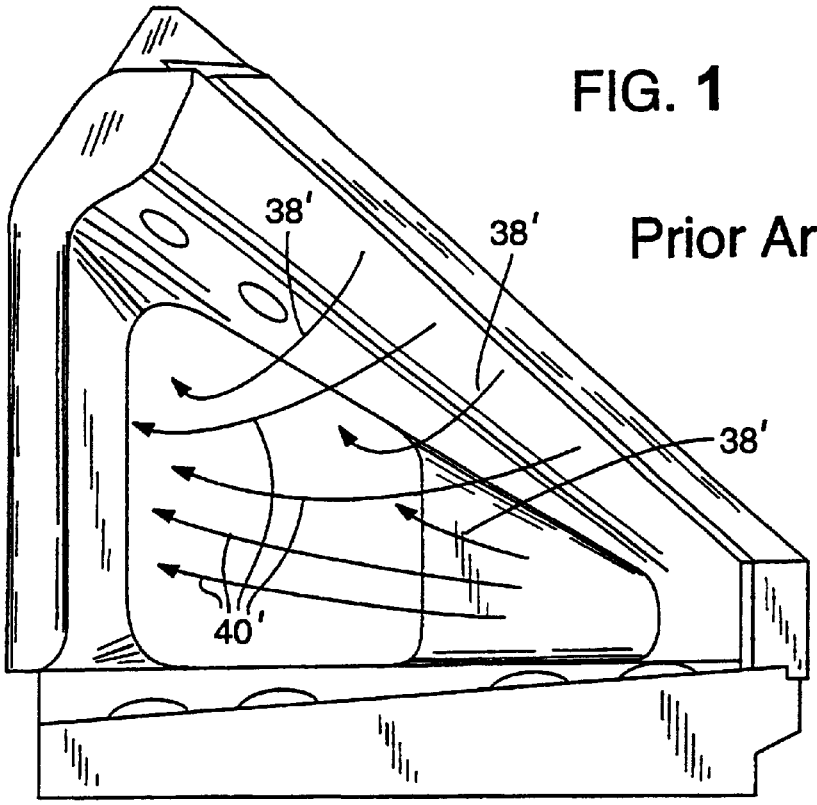
FIG. 1
Prior Art
FIG. 2
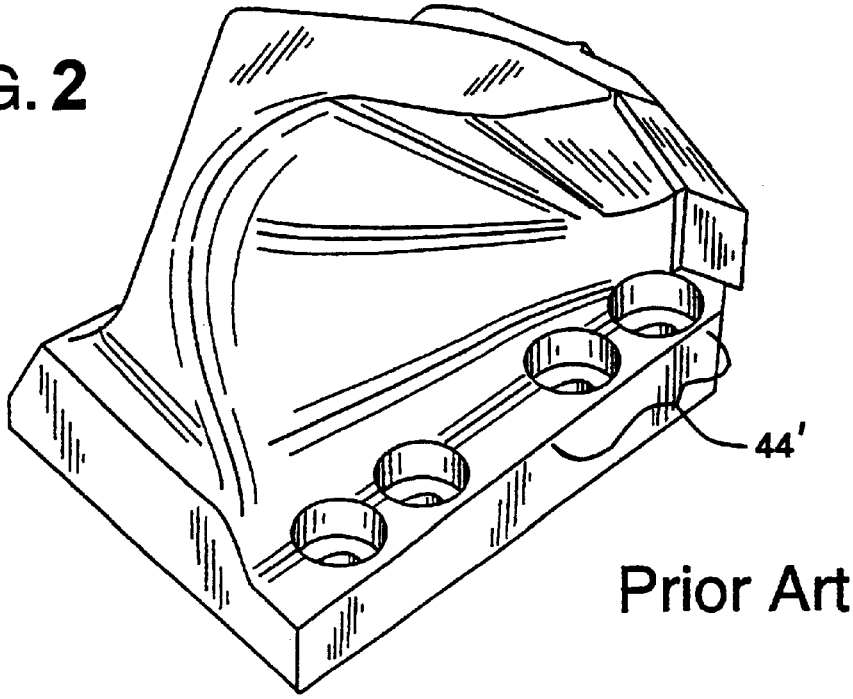
Prior Art

CANTER

FIELD OF THE INVENTION

This invention relates to the field of chipping heads employed in lumber processing, and in particular to an improved chipping head and wing knife holder structure for the reduction of chip damage.

BACKGROUND OF THE INVENTION

Applicant is aware of at least one attempt in the prior art to address the problem of chip breakage and crushing during the operation of a wing knife frustro-conical chipping head. In particular, applicant is aware of U.S. Pat. No. 5,505,239 which issued Apr. 9, 1996 to Sparks for a Blade Arrangement and Blade Holder for Chipper.

Sparks describes that a common use for such a chipper is to open the faces of a log. He describes the chipping operation formed on a log as removing the log material at two opposed sides, that is, outside of a vertical chord through each side of the log, thereby forming the so-called cant. Sparks identifies that the material removed by the chipper is valuable for making pulp especially if the material is cut into chips of generally consistent size. Sparks identifies that one problem in the prior art in the formation of chips has been that the chips formed by the blade on the chipping head flow past the blade and blade holder to strike an outer support leg supporting the blade holding structure. Sparks identifies as a second problem that in prior art knife formations, where two knives are abutted to form an angle comer or bend, that wood strands are driven into the interface between the two adjacent blades becoming wedged between the blades causing scoring of the opened faces on the cant.

The Sparks device replaces the prior art spaced leg supports with a single support wall that extends from a forward face of the chipping head, referred to as the inner side of the chipping head or the disc side, outwardly and rearwardly in a sweeping concave-like configuration that extends past the opening previously found between the blade holder and the leg supporting the blade holder. Sparks teaches that rearwardly curved or scoop-shaped surface formed in the support wall provides a guide way that receives and directs or guides the chips past the holder in the direction of natural flow of the chips as perceived by Sparks, Sparks stating that it had previously been perceived that the chip flow path flowed around the blade holder and through the opening between the blade holder and the leg support. As the teaching of Sparks would have it, the chips rather than passing through such an opening and under the blade holder, travel in a more direct outward direction so that a large portion impacts against the support leg causing the chips to break up or be crushed thereby rendering them less valuable for pulp production.

The stated objective of Sparks is to simulate the natural direction of chip flow in the radially outwardly diverging scoop formed underneath the blade holder along the supporting wall of the blade holder so as to avoid the direct impact of the chips against the leg support structure of the prior art. The prior art referred to by Sparks is illustrated herein in FIG. 1 for comparison purposes. The structure taught by Sparks is illustrated herein and identified as prior art in FIG. 2.

The present invention is directed to an observation by applicants that perhaps the teachings of Sparks were not entirely complete. In particular, applicants have noticed that wear patterns in the base structure of wing knife holders on Key-knife™ and Furano™ chipping heads indicate that a considerable volume of chip flow is at least initially directed downwardly. That is, the chip flow is directed radially inwardly relative to the axis of rotation of the chipping head, in a direction substantially perpendicular to the perceived lines of chip flow (indicated as lines 38' and 40') illustrated in the prior art as seen in FIGS. 1 and 2, so as to impinge the base structure. In particular, the primary wear pattern is located at a position on the base corresponding to the first two bolt positions nearest the inner side of the chipping head. For ease of reference the position of the primary wear pattern is indicated in FIG. 2 as 44'.

Applicant believes that the largest percentage of the chip formation occurs at the radially inner portion of the wing knife blade. This may be intuitively substantiated by a review of FIG. 3 and FIG. 3*a* which diagrammatically illustrate in plan view a log having an opposed pair of planar faces opened by an opposed facing pair of frustro-conical chipping heads so as to produce a cant flowing in the outfeed direction. As may be seen, the radially outermost portions of the wing knife blades engage the outermost edges of the log, that is, they do not have to slice through relatively long cord lengths through the log. Thus the relative volume of wood removed by the outer portions of the wing knife blades is lower, and hence the chip volume and flow rate is lower, than that created by the radially inner portions of the wing knife blades which slice through relatively longer cord lengths as the sides of the log are chipped away until the final cant dimensions are obtained and the cant passes between the opposed facing chipping head hubs.

Notwithstanding the distribution of the relative rate of chip formation along the length of the wing knife blades, the observed wear patterns on the base of prior art wing knife holders indicate significant chip flow against the innermost portion of the knife holder base, that is, adjacent the radially innermnost end of the wing knife blade. It is applicant's belief that such an impinging flow directed against a structure that in the prior art, including the teaching of Sparks, is a substantially flat plate, cannot but increase the incident of chip breakage and crushing. Thus, although no doubt chip breakage did occur in the prior art against the wing knife holder leg support as identified by Sparks, applicant believes that this is secondary damage compared to primary chip damage occurring at the leading edge side of the innermost portion the knife holder base.

Consequently, it is one of the objects of the present invention to provide a wing knife holder structure which is cantilevered in the form of a wing which extends radially outwardly beyond the base of the knife holder so as to minimize obstruction of the chip flow path, and which, contrary to the teaching of Sparks, in the present invention smoothly deflects chip flow initially in a radial inwardly direction while urging the chip flow to the outer side of the chipping head clear of interference from the rotating chipping head structure.

SUMMARY OF THE INVENTION

In summary, the present invention is an improved chipping head design incorporating an improved wing knife holder mountable onto the chipping head hub. The chipping head hub is an annular hub mounted for rotation in a rotational direction about an axis of rotation. When chipping a log a planar inner face of the hub is adjacent the log and substantially orthogonal to the axis of rotation.

A radially spaced array of the improved wing knife holders are mounted on a peripheral edge of the hub. Each wing knife holder has a plinth for releasable mounting of the knife holder to the peripheral edge of the hub. Advantageously, the plinth mounts to the hub from the rear, that is, the outer side of the hub opposite the inner face. A cantilevered member resembling a horn, arm or wing (and hereafter interchangeably referred to by any one of these terms) is mounted on the plinth. The cantilevered wing is inclined rearwardly and radially outwardly, from an inner end of the wing adjacent the plinth, to an outer end of the wing opposite the inner end. A leading edge of the wing extends between the inner and outer ends of the wing on a leading side of the wing, that is, leading in relation to the rotational direction of the chipping head. The leading edge is forwardly swept in the rotational direction from the inner end to the outer end so as to advance the outer end ahead of the inner end in the direction of rotation. The leading edge has a mounting platform recessed therein for mounting a wing knife and chip breaker onto the leading edge of the wing.

A chip flow passage is formed in the plinth of the wing knife holder. The chip flow passage is located radially inwardly of the leading edge, between peripheral edge of the hub and the leading edge of the wing. The chip flow passage slopes from an inner opening adjacent the peripheral edge of the hub rearwardly and radially inwardly toward the axis of rotation. The chip flow passage has a curved surface adjacent the hub which is arcuately shaped in a cross section viewed parallel to the inner face of the hub. The chip flow passage is curved in a second direction opposite to the rotational direction whereby chips cut by the wing knife are directed by the chip flow passage along a flow trajectory which is substantially free of obstructions from the inner face to the outer face of the hub. The chip flow passage may be a divergent chute diverging from the inner opening to a rear opening adjacent the outer face of the hub.

A buttress extends between the plinth and the wing. The buttress is positioned on the plinth rearwardly of the peripheral edge of the hub, set back in the second direction relative to the first chip flow-through passage so as not to substantially obstruct the flow path. The buttress extends from a radially inward portion of the plinth to a medial position along the wing between the inner and outer ends of the wing.

The peripheral edge of the hub formed therein or mounted thereon a radially spaced array of face planing knife holders defining second chip flow passages extending from the inner face rearwardly so as to pass to an opposite outer face of the hub. The face planing knife holders each accept into mounting engagement therein a face planing knife. The face planing knives are positioned so as to permit chips cut by each face planing knife to pass outwardly of the hub. The second chip flow-through passages are each radially staggering from the adjacent wing knife holders in the radially spaced array of wing knife holders. Alternatively, a facing saw is mounted adjacent the inner face of the hub. Advantageously, the plinth further comprises a plinth leg. The plinth leg extends radially inwardly relative to the peripheral edge of the hub for mounting to the outer face of the hub. Further advantageously, the hub has a notch in its outer face for mating engagement with the plinth leg.

In a further aspect of the present invention the inner face of the hub has annular recession therein. A face plate is rotatably mounted in the annular recession for free-floating rotation relative to the hub while the hub is rotating about the axis of rotation so as to reduce friction or loading on the hub from the hub rubbing on the log. This also reduces the tendency of small logs to be pulled through.

In yet a further aspect, a trailing edge of the wing, opposite the leading edge, is formed as a chip limiter. The chip limiter may be a curved member curving from the wing, in the second direction, so as to taper to a distal end adjacent the first chip flow-through passage on a next adjacent wing knife holder. In one embodiment, a radially outermost surface of the chip limiter is air-foil shaped for smoothly directing airflow between the distal end of the chip limiter and the leading edge on the next adjacent wing knife holder.

BRIEF DESCRIPTION OF THE DRAWINGS

FIG. 1 is, in side elevation view, a prior art wing knife holder.

FIG. 2 is, in perspective view, a second prior art wing knife holder.

DETAILED DESCRIPTION OF THE PREFERRED EMBODIMENT

Figure 3:
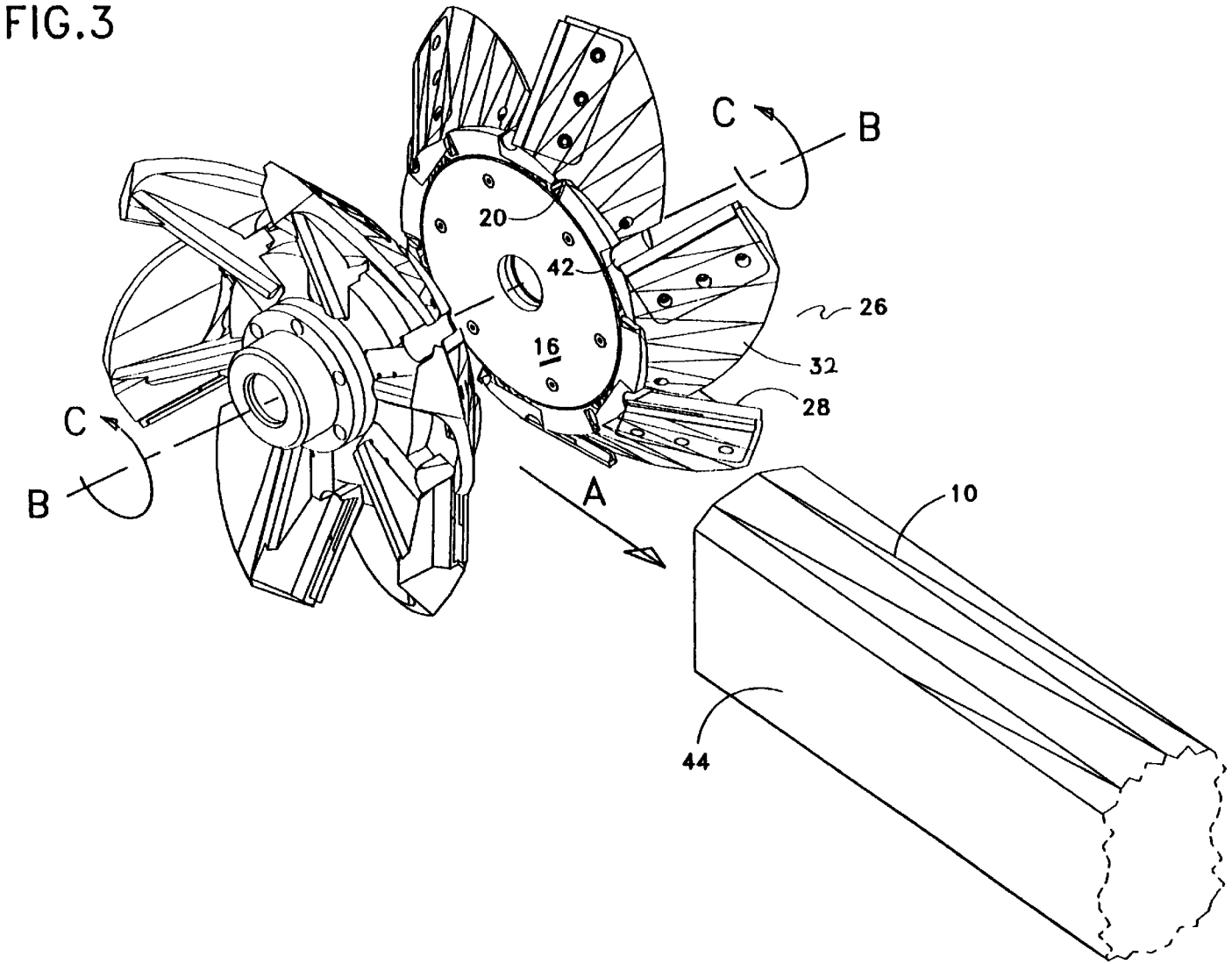
FIG. 3 is, in partially exploded perspective view, an opposed facing pair of chipping heads according to the present invention canting a log.
Figure 3A:
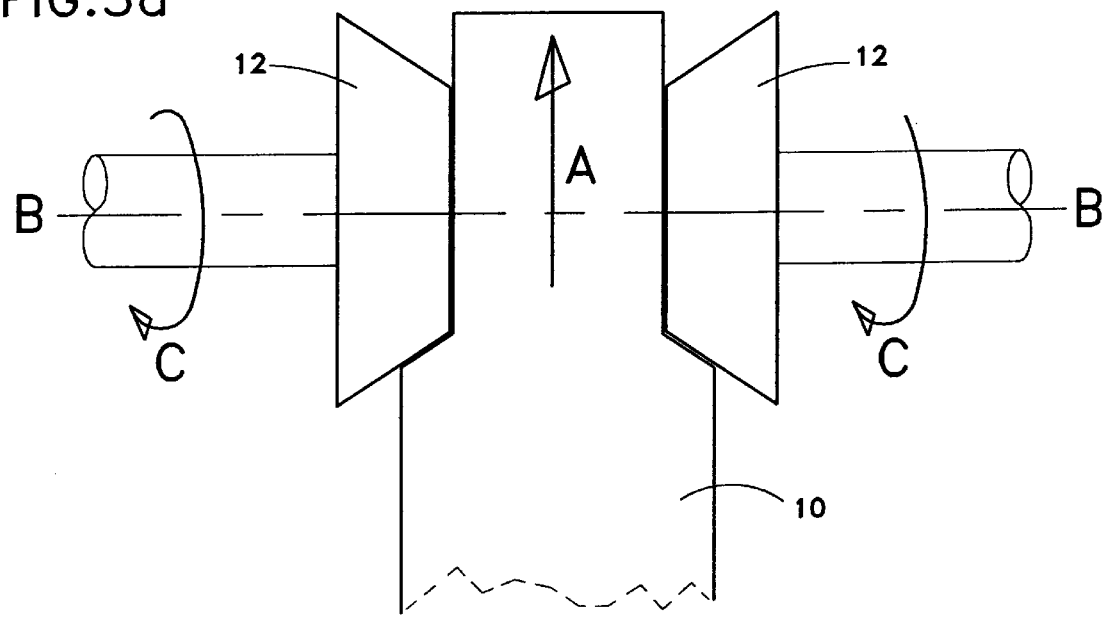
FIG. 3*a* is, in plan view, the chipping heads of FIG. 3 canting a log.
Figure 3B:
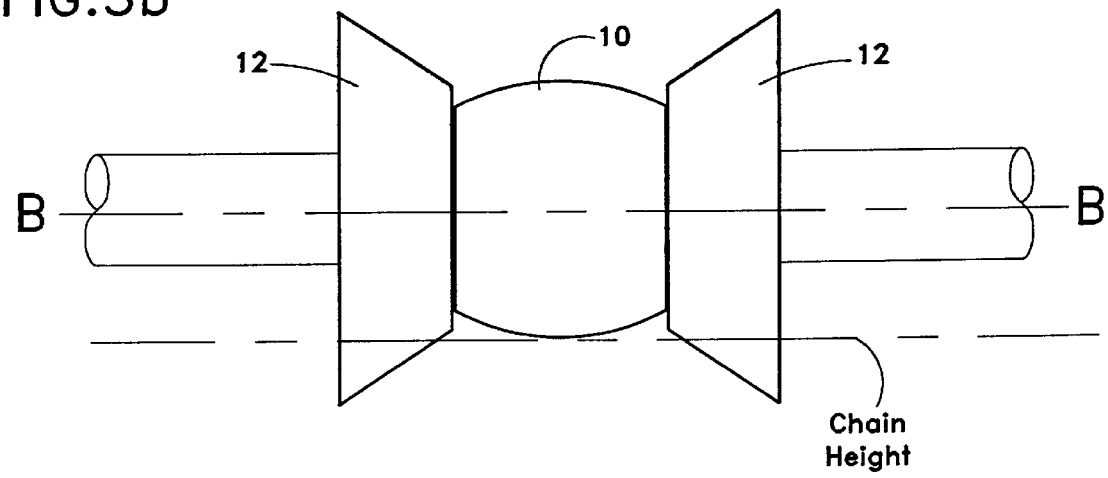
FIG. 3*b* is, in end elevation view, the chipping heads of FIG. 3 canting a log.

FIGS. 1 and 2 illustrate prior art wing-knife holders as described above. FIG. 3 illustrates in exploded perspective view a log 10 which is conveyed along a path A, so as to be brought into chipping engagement with rotating chipper heads 12. The axis of rotation B of chippers head 12 is at right angles to path A. The direction or rotation of chipper head 12 is indicated by arrow C. The action of rotating chipper head 12 against log 10 results in the removal of a portion of the log in the form of wood chips which can be utilized for pulp manufacture, and leaves a planar faced log or so-called cant.

Each chipper head 12 has an inner face 16 adjacent path A. An outer face 18 is spaced outwardly therefrom, that is, opposite inner face 16. Chipper head 12 may be axially translatable inwardly toward path A, or may be articulated for example for use in curve sawing operations, as is necessary to process logs of a variety of diameters and curvatures which are conveyed in succession along path A.

Figure 4:
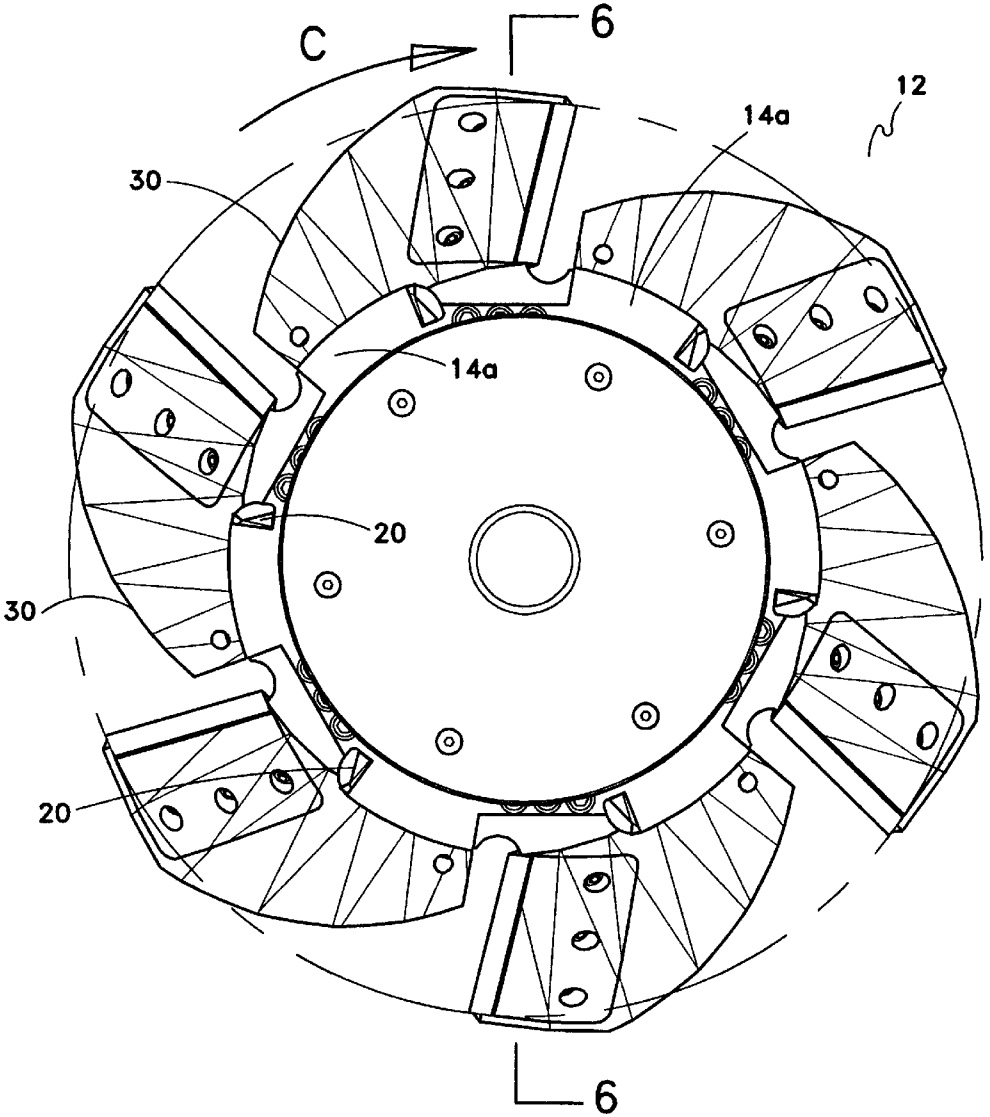
FIG. 4 is, in front elevation view, a chipping head according to the present invention.
Figure 5:
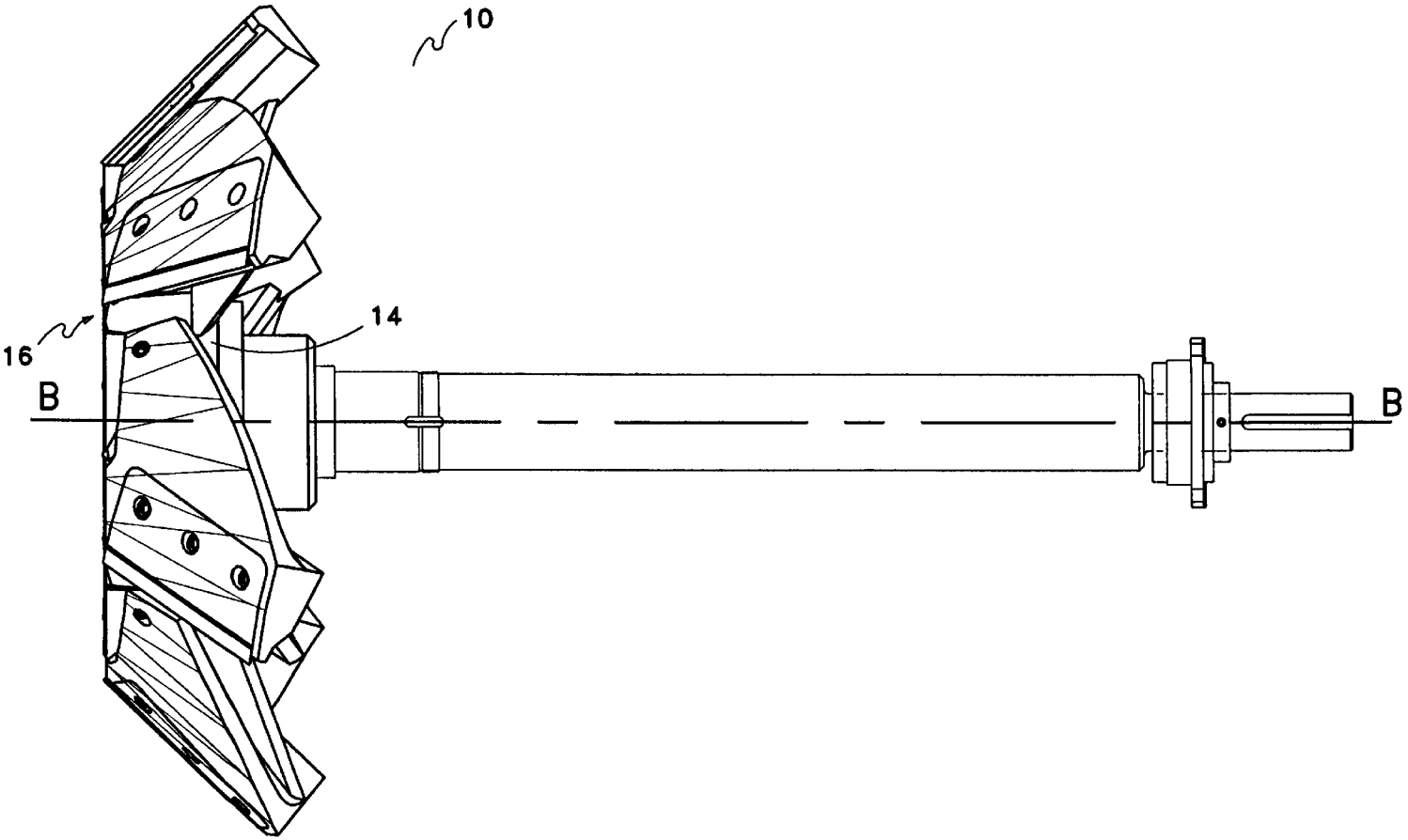
FIG. 5 is, in side elevation view, the chipping head of FIG. 4 mounted on a drive shaft by means of secondary or retro-fit hub.
Figure 6:
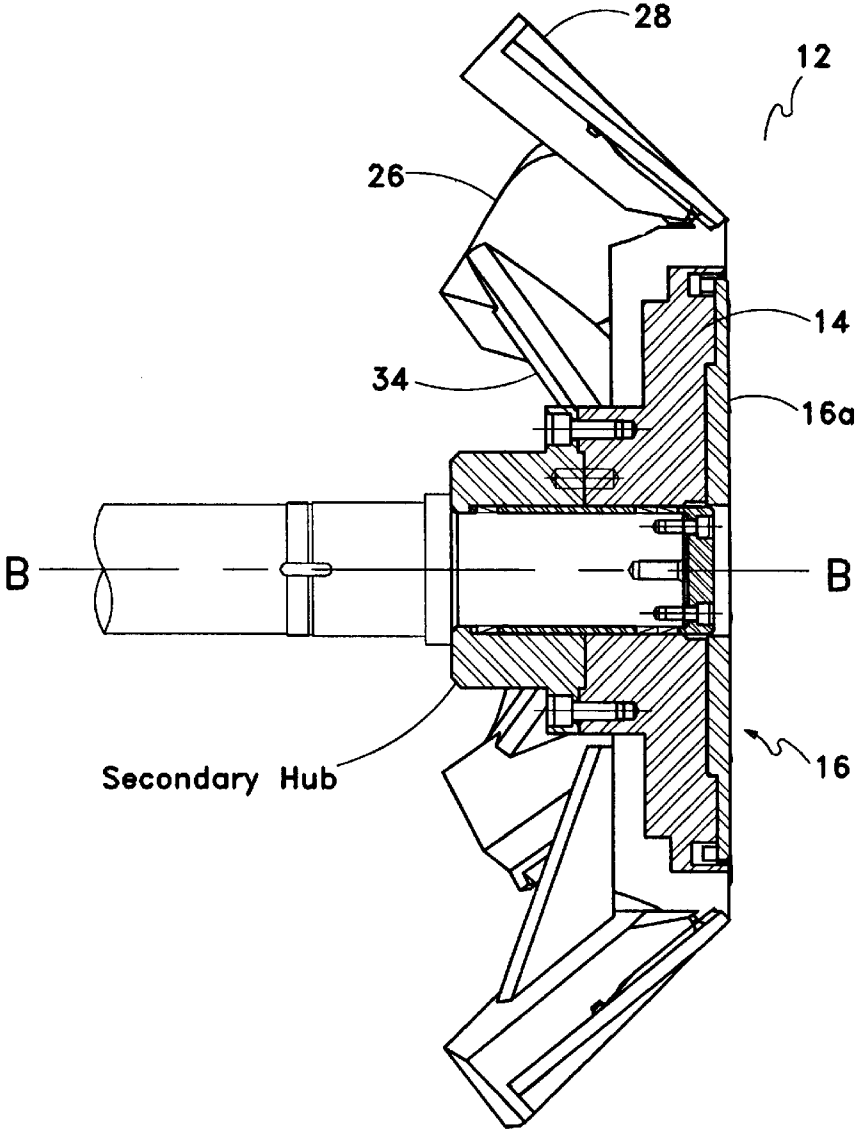
FIG. 6 is, a sectional view along line 6—6 in FIG. 4.
Figure 7:
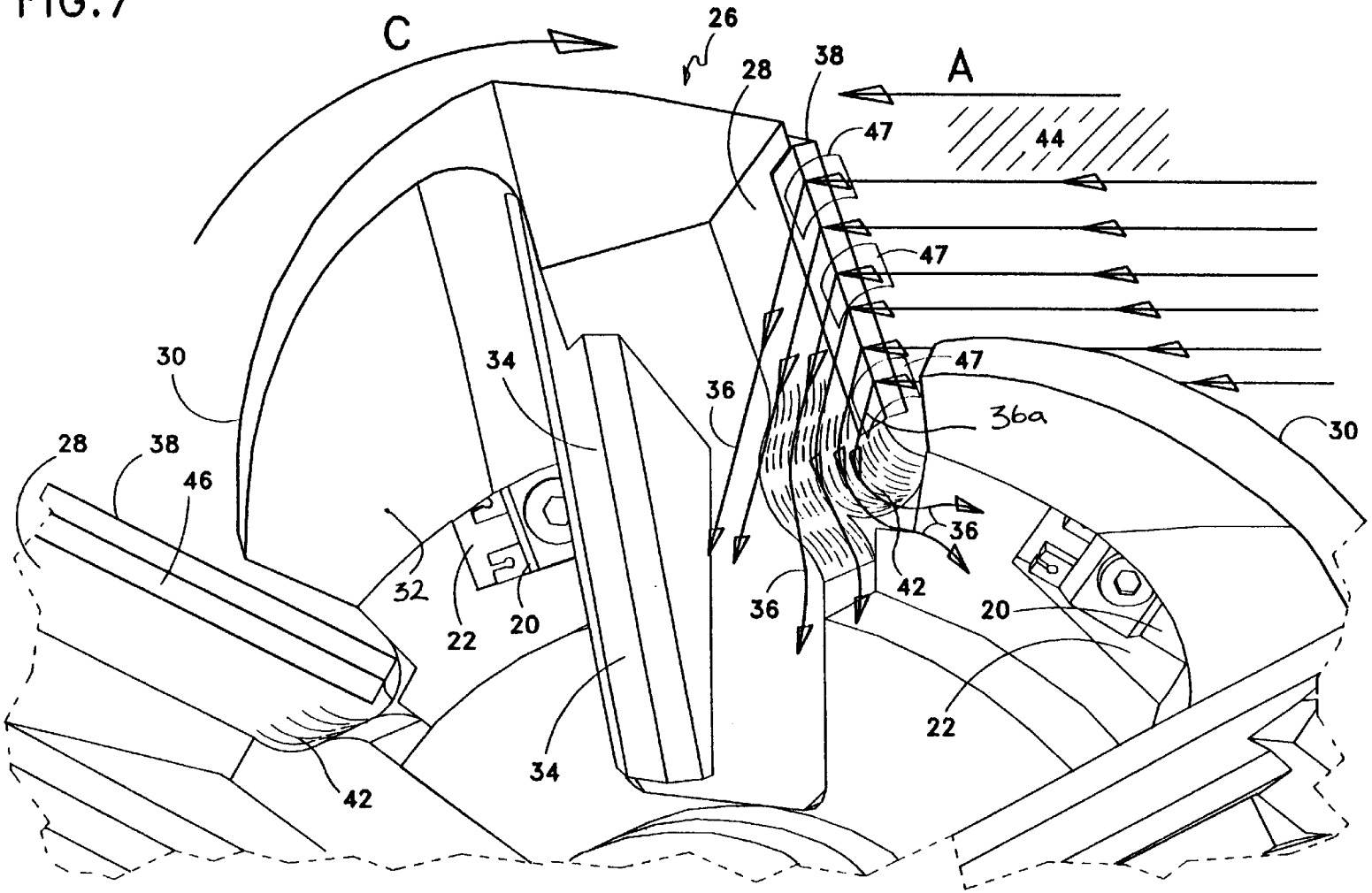
FIG. 7 is, in rear perspective view, a wing knife holder according to the present invention mounted on a chipping head hub.

As seen in FIGS. 4–6, chipper head 12 has an annular hub 14. Inner face 16 of hub 14 may have recessed therein a flush mounted, freely rotatable face plate 16a freely rotatable about axis B. Face plate 16*a* may be slightly smaller in diameter than hub 14 thereby exposing face periphery 14*a* around the periphery of hub 14. Face periphery 14*a* may in one embodiment provide for securely mounting face planing knives 20 within chip removal passages 22 formed in face periphery 14*a* as better seen in FIG. 7.

Figure 9:
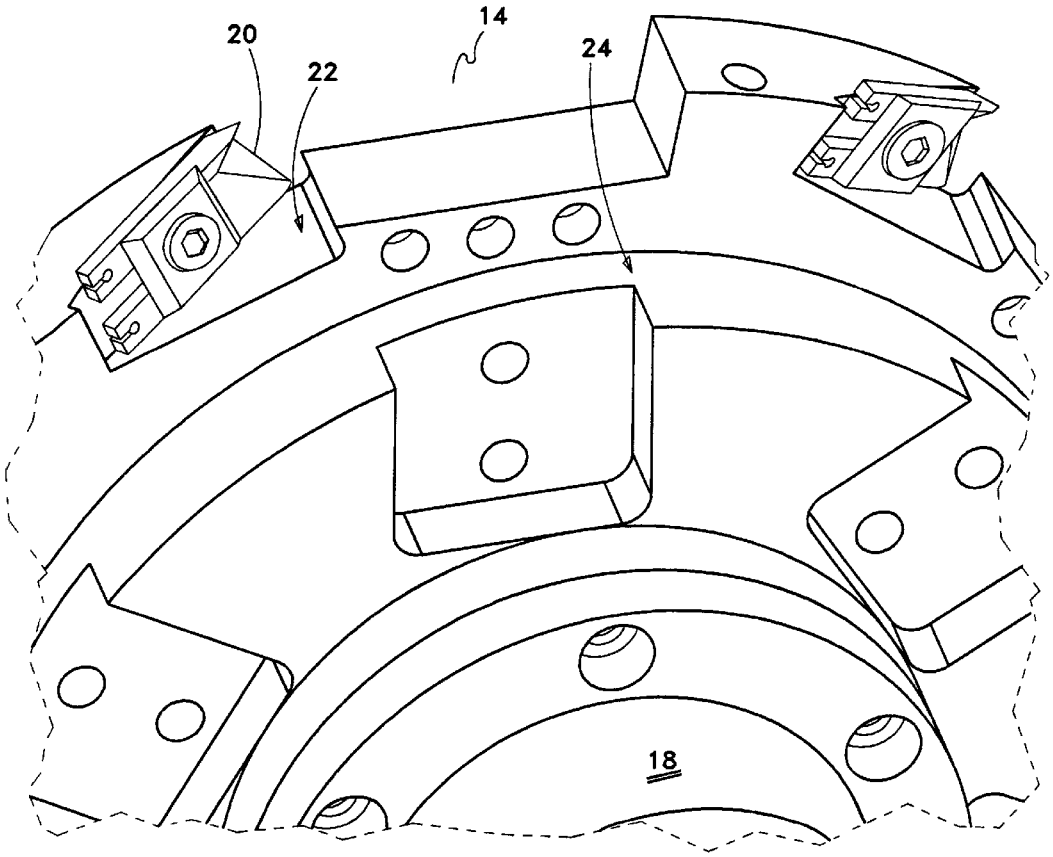
FIG. 9 is, in partially cut away rear perspective view, the chipping knife hub with the wing knife holder removed.

Wing knife holders 26 are mounted on peripheral edge 24 of annular hub 14 in a spaced apart radial array. In the preferred embodiment of the invention, there are 6*b* such wing knife holders which extend radially outwardly from the peripheral edge 24 of hub 14. Each knife holder 26 is cantilevered radially outwardly relative to axis B and rearwardly of inner face 16. Thus during rotation of chipper head 12, knife holders 26 sweep out a frustro-conical surface about axis B. Each knife holder 26 has a leading edge 28 and a trailing edge 30 on a wing portion 31 of the structure. Leading edge 28 of knife holder 26 is linear and is also inclined rearwardly, away from inner face 16 of hub 14. Wing portion 31 is mounted onto plinth portion 33. It is plinth portion 33 which is mounted to hub 14 by means of bolting the leg portion 35 of the plinth into a recessed land in outer face 18 as seen in FIG. 9.

The outer end 37 of wing portion 31, that is, the end furthest from inner face 16, is advanced in the direction of rotation C relative to the opposite inner end 39. Leading edge 28 is thus forwardly swept relative to the direction of rotation of the chipping head.

A buttress support 34 extends between leg portion 35 and a generally medial location along wing portion 31. Buttress 34 is set back from trailing edge 28 relative to direction of rotation C. This positioning of support 34 in relation to the leading edge of the knife holder 26 creates a substantially unobstructed chip flow path 36 which extends rearwardly of inner face 16 towards outer face 18 and radially inwardly toward axis B from the leading edge of radially inner portion of 28. Buttress support 34 rigidly supports the radially inner half of wing portion 31 to thus support the radially inner half of the wing knife blade and chip breaker where a large percentage of the chip forming occurs. Buttress 34 is also set back from leading edge 28. Thus the radially outer end 37 of wing portion 31 is cantilevered rearwardly and radially outwardly from buttress 34 and leading edge 28 is cantilevered in a forward direction relative to direction of rotation C from buttress 24 thereby facilitating an unobstructed chip flow path from both the face planing knives 20 and the wing knives 38. Chip flow path 36 is directed by chute 42.

Figure 10:
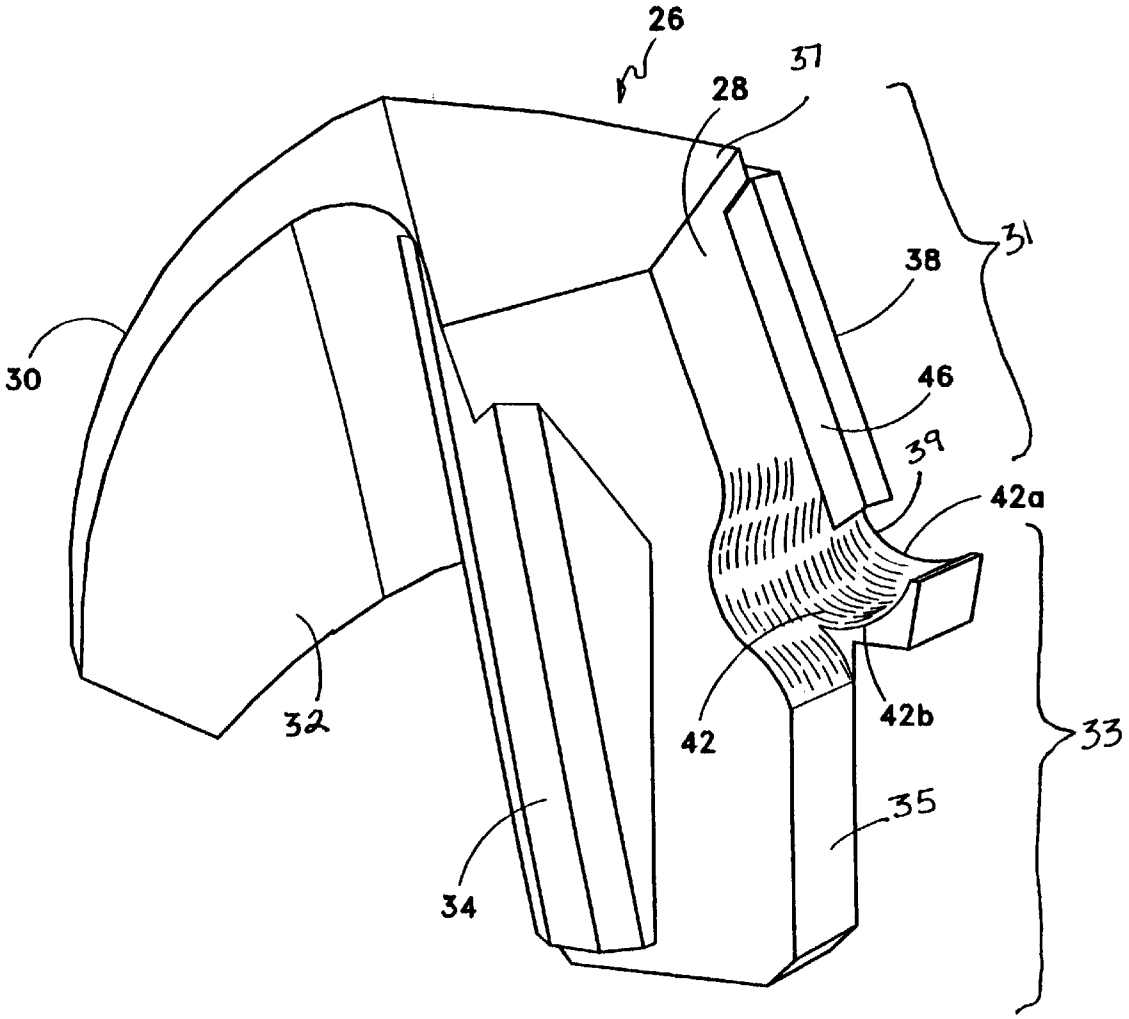
FIG. 10 is, in rear perspective view, the wing knife holder of FIG. 7.

Chute 42 is located between leading edge 28 and plinth 33. Chute 42, best seen in FIGS. 7 and 10 serves as a chip flow passage. It is generally curved or arcuately shaped when viewed in a cross section taken parallel to inner face 16. Chute 42 extends radially inwardly relative to the hub from inner face 16 towards axis B in a direction which gently curves in a direction opposite rotational direction C. Chute 42 diverges, i.e. opens-out, from its mouth 42*a* to its exit or rearmost opening 42*b*.

Figure 8:
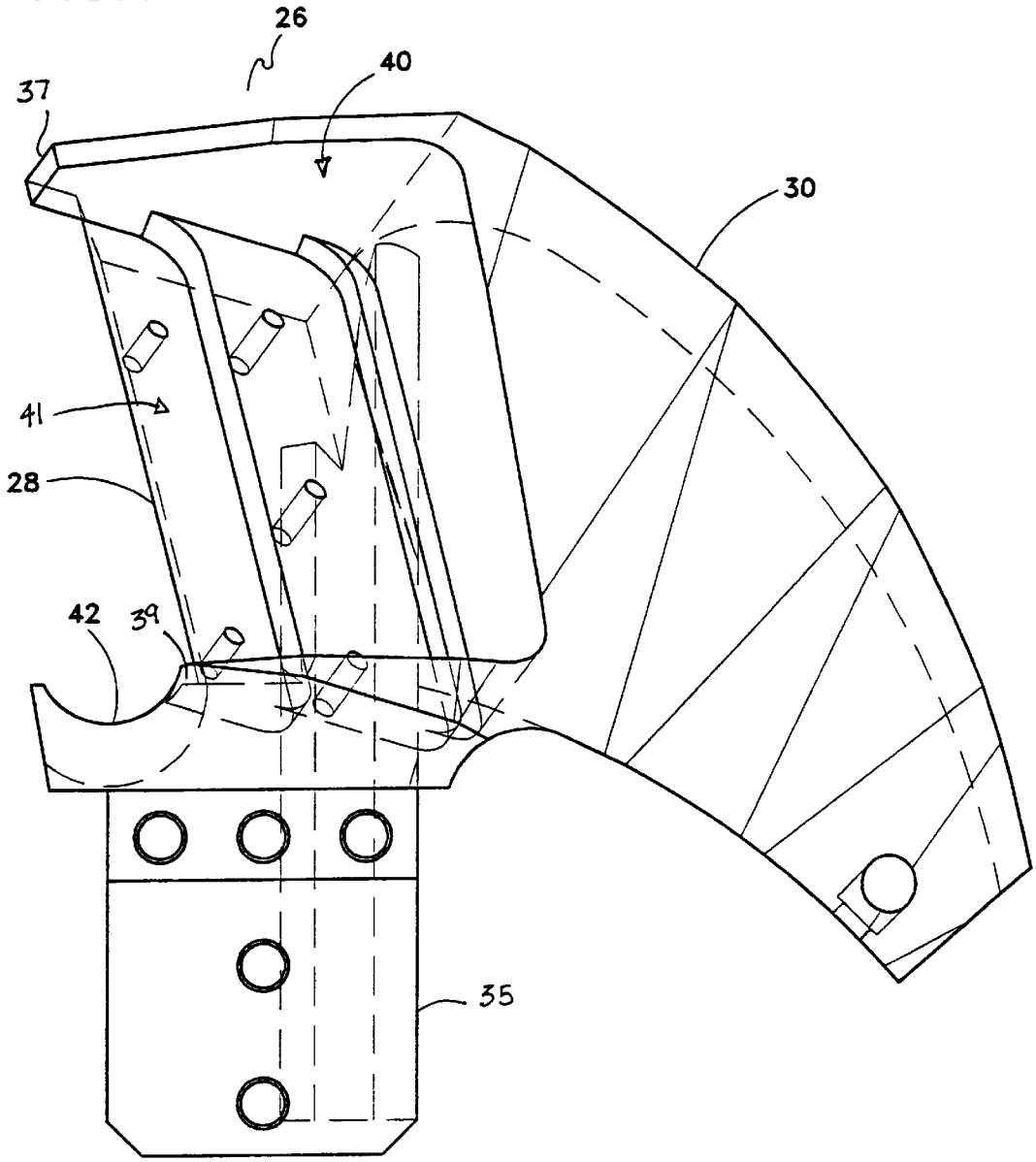
FIG. 8 is, in front elevation view, the wing knife holder of FIG. 7.

Wing knife 38 is removably mounted on a recessed platform 40, seen in FIG. 8, in holder 26. A chip breaker insert plate 46 is sandwiched between knife 38 and platform 40. Chip breaker plate 46 is nested within a further recess 41 so that its leading edge is set back from leading edge 28.

As wing knife 38 rotates across an exposed face 44 of log 10, leading edge 28 comes into contact with the log at a point along the leading edge which is coincident with the pre-set depth of cut. That is, wing knife 38 contacts the log at a point along the knife blade which corresponds to the pre-set depth of cut. During chipping, chips 47 curl off log 10 under chipping knife 38. The chip comes into contact with chip breaker plate 46 which forces the chip to rotate away approximately 110° in one embodiment from the cutting plane of chipping knife 38 causing the chip to break off in a generally uniform length. When the chip is free of breaker plate 46, it is directed along chute 42. The chip flow path 36 originating along the radially inner portion of knife 38 initially flows in a direction having a flow path vector 36*a* directed radially inwards It is this flow path vector which in the prior art results in the chip flow impinging the flat-surfaced plinth of the knife holder. Because chute 42 is radially inwardly inclined, the chip flow path is turned or deflected thereby distributing the force in vector direction 36*a* of the chip flow mass along the length of chute 42 resulting in reduced chip damage and reduced fines. Chip chute 42 in an alternative embodiment may have a removable liner (not shown).

The trailing edge 30 of wing portion 31 may be formed as a chip limiter 32 to provide a solid surface between adjacent wing knives 38. Chip limiters 32 inhibit lurching of log 10 into the spaces between the wing knives during the chipping process which could cause the chipping head to jam or to stall.

As best understood by reference to FIGS. 3 and 4, and as known in the art, face planing knives 20 are positioned so as to protrude their cutting edges outwardly of the exposed face portion 14*a* of annular hub 14.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A chipping head comprising:

an annular hub mounted for rotation in a rotational direction about an axis of rotation, when chipping a log, a planar inner face of said hub, adjacent said log during said chipping of said log, being substantially orthogonal to said axis of rotation, a equally spaced array of wing knife holders mounted radially around said hub, each said wing knife holder having a plinth for releasable mounting of said knife holder to said hub, a cantilevered wing mounted on said plinth, said cantilevered wing inclined rearwardly and radially outwardly, from an inner end of said wing adjacent said plinth and said peripheral edge of said hub, to an outer end of said wing opposite said inner end, a leading edge of said wing extending between said inner and outer ends of said wing on a leading side of said wing, leading in said rotational direction of said chipping head, said leading edge forwardly swept in said rotational direction from said inner end to said outer end so as to advance said outer end ahead of said inner end in said direction of rotation, said leading edge having a mounting platform recessed therein for mounting a wing knife and chip breaker onto said leading edge.

2. The chipping head of claim 1 further comprising a chip flow passage formed in said plinth, radially inwardly of said leading edge between said peripheral edge and said leading edge, said chip flow passage sloping from an inner opening adjacent said peripheral edge rearwardly and radially inwardly toward said axis of rotation, said chip flow passage having a curved surface for deflecting chips, said chip flow passage curved in a second direction opposite to said rotational direction whereby chips cut by said wing knife are directed by said chip flow passage along a flow trajectory which is substantially free of obstructions from said inner face to said outer face of said hub.

3. The chipping head of claim 2 wherein a facing saw is mounted adjacent said inner face of said hub.

4. The chipping head of claim 2 wherein said plinth further comprises a plinth leg, and wherein said plinth leg of said plinth extends radially inwardly relative to said peripheral edge for mounting to said outer face of said hub.

5. The chipping head of claim 4 wherein said outer face of said hub has a notch for mating engagement therein of said plinth leg of said plinth.

6. The chipping head of claim 4 wherein said plinth further comprises a buttress extending between said plinth leg and said wing.

7. The chipping head of claim 6 wherein said buttress is positioned on said plinth rearwardly of said peripheral edge of said hub, set back in said second direction relative to said first chip flow-through passage so as not to substantially obstruct said flow path.

8. The chipping head of claim 7 wherein said buttress extends from a radially inward portion of said plinth leg to a medial position along said wing between said inner and outer ends of said wing.

9. The chipping head of claim 1 wherein said chip flow passage is a divergent chute diverging from said inner opening to a rear opening adjacent said outer face of said hub.

10. The chipping head of claim 1 wherein said inner face has a face plate rotatably mounted thereto for free-floating rotation relative to said hub while said hub is rotating about said axis of rotation.

11. The chipping head of claim 1 wherein a trailing edge of said wing, opposite said leading edge, is formed as a chip limiter.

12. The chipping head of claim 11 wherein said chip limiter is a curved member curving from said wing, in said second direction, to a distal end adjacent said first chip flow-through passage on a next adjacent wing knife holder.

13. The chipping head of claim 12 wherein said chip limiter tapers towards said distal end.

14. The chipping head of claim 12 wherein a radially outermost surface of said chip limiter is air-foil shaped for smoothly directing airflow between said distal end of said chip limiter and said leading edge on said next adjacent wing knife holder.

15. A wing knife holder for a chipping head, wherein said chipping head is rotatable in a direction of rotation about an axis of rotation of said chipping head, a centrally disposed hub of said chipping head having an inner face generally orthogonal to said axis of rotation and an outer face opposite said inner face, a plurality of said wing knife holders mountable in equally spaced array radially around a peripheral edge of said hub, said wing knife holder comprising;

a plinth for releasable mounting of said knife holder to said hub, a cantilevered wing mounted on said plinth, said cantilevered wing inclined rearwardly and radially outwardly, from an inner end of said wing adjacent said plinth to an outer end of said wing opposite said inner end, a leading edge of said wing extending between said inner and outer ends of said wing on a leading side of said wing, leading in said rotational direction of said chipping head, when said wing knife holder is mounted on said hub, said leading edge forwardly swept in said rotational direction from said inner end, when said wing knife holder is mounted on said hub, to said outer end so as to advance said outer end ahead of said inner end in said direction of rotation, said leading edge having a mounting platform recessed therein for mounting a wing knife and chip breaker onto said leading edge.

16. The wing knife holder of claim 15 further comprising a chip flow passage formed in said plinth, radially inwardly of said leading edge and forwardly of said leading edge in said rotational direction, between said peripheral edge and said leading edge when said wing knife holder is mounted on said hub, said chip flow passage sloping from an inner opening adjacent said peripheral edge, when said wing knife holder is mounted on said hub, rearwardly and radially inwardly toward said axis of rotation, said chip flow passage having a curved surface for deflecting chips, said chip flow passage curved in a second direction opposite to said rotational direction when said wing knife holder is mounted on said hub, whereby chips cut by said wing knife are directed by said chip flow passage along a flow trajectory which is substantially free of obstructions from said inner face to said outer face of said hub.

17. The wing knife holder of claim 16 wherein said plinth further comprises a plinth leg, and wherein said plinth leg of said plinth extends radially inwardly relative to said peripheral edge for mounting to said outer face of said hub when said wing knife holder is mounted on said hub.

18. The wing knife holder of claim 17 wherein said plinth further comprises a buttress extending between said plinth leg and said wing.

19. The wing knife holder of claim 18 wherein said buttress is positioned on said plinth rearwardly of said peripheral edge of said hub, when said wing knife holder is mounted on said hub, set back in said second direction relative to said chip flow passage so as not to substantially obstruct said flow trajectory.

20. The wing knife holder of claim 19 wherein said buttress extends from a radially inward portion of said plinth leg to a medial position along said wing between said inner and outer ends of said wing.

21. The wing knife holder of claim 16 wherein said chip flow passage is a divergent chute diverging from said inner opening to a rear opening adjacent said outer face of said hub, when said wing knife holder is mounted on said hub.

22. The wing knife holder of claim 16 wherein a trailing edge of said wing, opposite said leading edge, is formed as a chip limiter.

23. The wing knife holder of claim 22 wherein said chip limiter is a curved member curving from said wing, in said second direction, when said wing knife holder is mounted on said hub, to a distal end adjacent said chip flow passage on a next adjacent knife holder mounted on said hub.

24. The wing knife holder of claim 23 wherein said chip limiter tapers towards said distal end.

25. The wing knife holder of claim 23 wherein a radially outermost surface of said chip limiter is air-foil shaped for smoothly directing airflow between said distal end of said chip limiter and said leading edge on said next adjacent wing knife holder.

* * * * *